US007003250B2

(12) United States Patent
Sano et al.

(10) Patent No.: US 7,003,250 B2
(45) Date of Patent: Feb. 21, 2006

(54) TWO COMPONENT DEVELOPMENT APPARATUS AND PROCESS CARTRIDGE

(75) Inventors: Junichi Sano, Tokyo (JP); Takeyoshi Sekine, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 210 days.

(21) Appl. No.: 10/745,532

(22) Filed: Dec. 29, 2003

(65) Prior Publication Data

US 2004/0190948 A1 Sep. 30, 2004

(30) Foreign Application Priority Data

Dec. 26, 2002 (JP) ..... 2002-376250
Feb. 5, 2003 (JP) ..... 2003-027904

(51) Int. Cl.
*G03G 15/08* (2006.01)
*G03G 15/09* (2006.01)

(52) U.S. Cl. ..... 399/284; 399/274

(58) Field of Classification Search ..... 399/256, 399/258, 265, 281, 272–274, 283, 284
See application file for complete search history.

(56) References Cited

U.S. PATENT DOCUMENTS 5,131,079 A 7/1992 Miyawaki et al.
5,227,842 A 7/1993 Hayashi et al.
5,270,783 A 12/1993 Bisaiji et al.
5,327,199 A 7/1994 Sekine
5,648,842 A 7/1997 Sekine et al.
5,913,092 A 6/1999 Bisaiji et al.
6,125,257 A 9/2000 Sekine et al.
6,343,201 B1 * 1/2002 Wada et al. ..... 399/281
6,442,364 B1 8/2002 Kai et al.
RE38,026 E * 3/2003 Tada et al. ..... 399/274
6,553,202 B1 * 4/2003 Tamaki et al. ..... 399/258
6,597,885 B1 7/2003 Kai et al.
6,701,114 B1 3/2004 Sekine et al.

FOREIGN PATENT DOCUMENTS

EP 0 774 700 5/1997
JP 10-232540 9/1998
JP 2002-139914 5/2002

OTHER PUBLICATIONS

U.S. Appl. No. 09/944,076, filed Sep. 4, 2001, Ariizumi et al.

(Continued)

*Primary Examiner*—Susan Lee
(74) *Attorney, Agent, or Firm*—Oblon, Spivak, McClelland, Maier & Neustadt, P.C.

(57) ABSTRACT

A two-component developing apparatus includes a developer carrier, a first regulating member, a developer container, and a toner container. The developer carrier is configured to carry and transfer the two-component developer including a magnetic carrier. The first regulating member is configured to regulate an amount of the two-component developer carried and transferred by the developer carrier. The developer container is configured to receive the developer removed by the first, regulating member. The toner container is configured to supply toner to the developer carrier. The developer stirring member is configured to carry and stir the developer between the first regulating member and the second regulating member. The second regulating member includes a support member on one end side of the second regulating member in its longitudinal direction to which greater amount of the developer is supplied than to another end side of the second regulating member.

29 Claims, 16 Drawing Sheets

OTHER PUBLICATIONS

U.S. Appl. No. 10/083,159, filed Feb. 27, 2002, Ikeguchi et al.
U.S. Appl. No. 10/155,111, filed May 28, 2002, Sano.
U.S. Appl. No. 10/229,008, filed Aug. 28, 2002, Ohyama.
U.S. Appl. No. 10/285,636, filed Nov. 1, 2002, Ohjimi et al.
U.S. Appl. No. 10/303,910, filed Nov. 26, 2002, Sampe et al.
U.S. Appl. No. 10/459,562, filed Jun. 12, 2003, Kai et al.

* cited by examiner

| | CENTER | RIGHT END |
|---|---|---|
| WITHOUT SUPPORT MEMBER | 1.38 | 1.28 |
| WITH SUPPORT MEMBER | 1.40 | 1.38 |

TWO COMPONENT DEVELOPMENT APPARATUS AND PROCESS CARTRIDGE

CROSS-REFERENCE TO RELATED APPLICATIONS

This patent specification is based on Japanese patent application, No. 2002-376250 filed on Dec. 26, 2002 and No. 2003-027904 filed on Feb. 5, 2003 in the Japanese Patent Office, which are hereby incorporated by reference in its entirety.

FIELD OF THE INVENTION

The present invention relates to a two-component development apparatus and a process cartridge for using toner as a developer for developing an electrostatic image in electrophotography, electrostatic recording and electrostatic printing and the like, and an electrophotographic developing apparatus which uses toner. More particularly, the present invention relates to a two-component development apparatus and a process cartridge used in an image forming apparatus for use in copiers, laser printers and plain-paper facsimile machines and so on which use a direct or indirect electrophotographic development method.

BACKGROUND OF THE INVENTION

In electrophotography, an image forming method typically uses a photoconductive substance to form an electrostatic latent image on an electrostatic image carrying member using various means. The electrostatic latent image is then developed with toner and is transferred on a recording sheet and the like as desired. Subsequently, the toner is fixed by heating or solvent vapor so that copy images or printed images can be obtained. For developing latent electrostatic images formed on an electrophotographic image carrier such as a photoconductor to visible toner images, there are conventionally proposed two methods: a wet-type developing method using a liquid type developer, and a dry-type developing method using a dory-type developer. The dry-type developer includes a one-component dry-type developer comprising a toner obtained by dispersing a coloring agent such as a colorant in a binder resin; and a two-component dry-type developer obtained by mixing the above-mentioned toner and carrier particles. Although these methods individually have their own advantages and shortcomings, the dry-type developing method is more prevalent than the wet-type developing method.

Since in the two-component developing method it is relatively easy to increase operation speed and lengthen lifetime as compared with the one-component developing method, the two component developing method is widely used for medium and high speed copiers and printers.

For carrying out the above-mentioned developing method, the developing device employs the two-component developing method for controlling toner concentration using two developer regulating members and a developer carrier. This system eliminates a sensor and a toner supply controlling device, thereby making a device relatively inexpensive and compact.

The above-mentioned developing device, however, has several disadvantages. One disadvantage is that it prevents a compulsive toner supplying control. As a result, a toner concentration control depends on a gap between a regulating member and the developer carrier, a gap between a developer stirring member and the developer carrier, and magnetic flux density caused by a magnet of the developer carrier, and a peak magnetic flux density and a position of one half band width (i.e., angle) of the developer carrier.

However, assembling deviations caused by a regulation gap of the two regulating members (i.e., first and second regulating members), manufacturing precision and tolerances of parts, and magnetic flux density deviation caused by a magnet of the developer carrier cause an amount of the developer regulating deviation. Therefore, the developer tends to be axially located in a longitudinal direction of the developer carrier. This causes the developer to be nearer one end of a development region. An increase in the developer at one end decreases toner, thereby causing a loss in image concentration. A decrease in the developer at one end increases toner, thereby causing a soiling of background.

Further, the two-component developing device with a toner concentration controlling function can be downsized so that it can be utilized for a compact printer and the like. The compact printer is often placed on a desk so that the printer tends to be operated in an inclined position as compared to a large printer placed on a floor. Such an inclined printer tends to make the developer move to one end. This leads to a loss in latent image concentration and a soiling of background at one end.

Therefore, a high parts tolerance and assembly precision are demanded in this system. Utilizing a machine in a horizontal position is required. As long as the above-mentioned condition is not satisfied, unusual images such as uneven image concentration and a soiling of background tend to be generated.

SUMMARY OF THE INVENTION

Accordingly, the present invention advantageously provides a process cartridge including a housing, at least one of a latent image carrier, a charging mechanism, and a cleaning mechanism, and a developing mechanism configured to have a two-component developing apparatus for use in an image forming apparatus.

The developer apparatus of the present invention advantageously includes a developer carrier configured to carry and transfer a two-component developer including a magnetic carrier. The developer apparatus also includes a first regulating member configured to regulate an amount of the two-component developer carried and transferred by the developer carrier, and a developer container including a second regulating member positioned upstream of the first regulating member in a direction of developer conveyance of the developer carrier and configured to receive the developer removed by the first regulating member. The developer apparatus further includes a toner container formed adjacent to the developer container and configured to supply toner to the developer carrier, and a developer stirring member configured to carry and stir the developer between the first regulating member and the second regulating member. The second regulating member includes a support member on one end side of the second regulating member in a longitudinal direction thereof to which greater amount of the developer is supplied than to another end side of the second regulating member.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, in which.

DETAILED DESCRIPTION OF PREFERRED EMBODIMENTS

Figure 1:
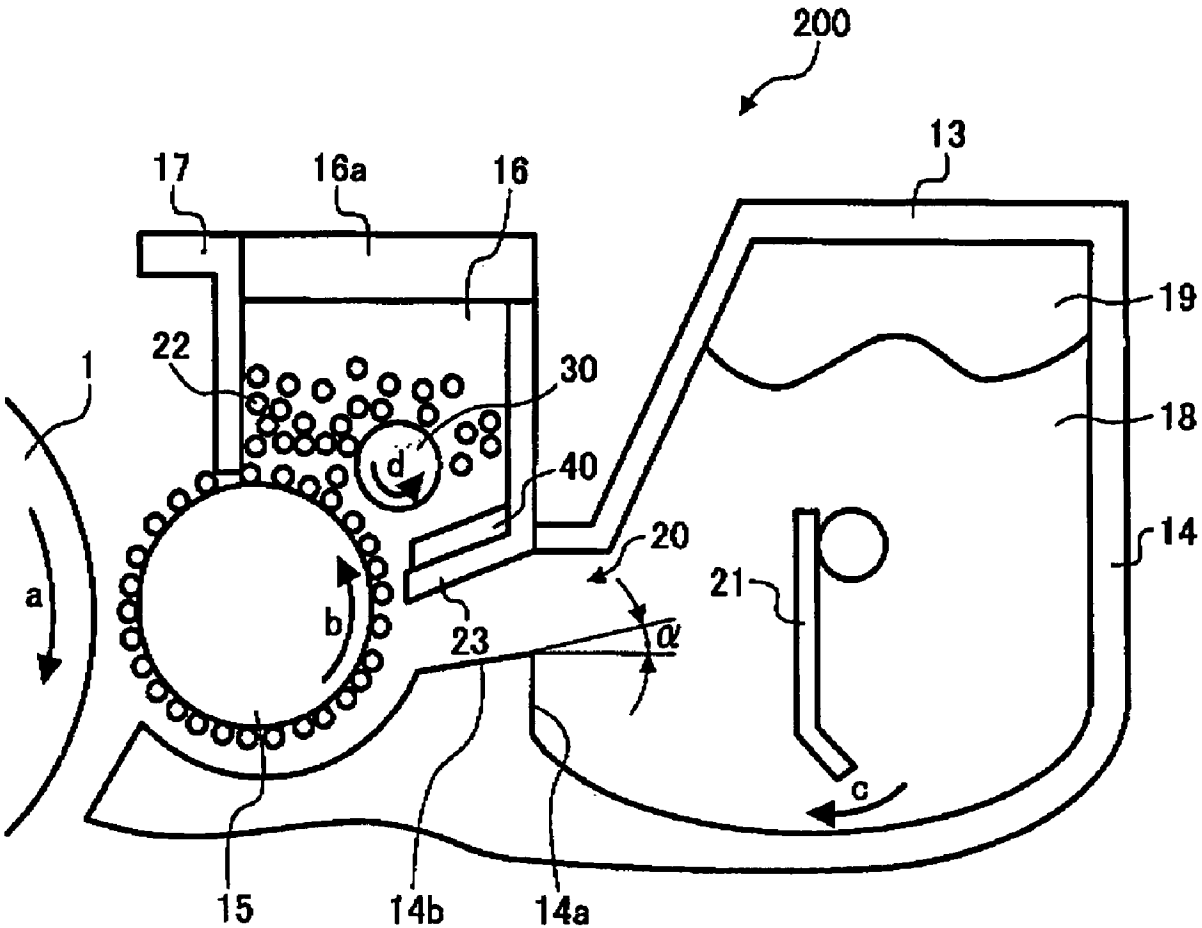
FIG. 1 is a schematic drawing illustrating an exemplary developing unit of an image forming apparatus using a preferred embodiment of a two-component development apparatus according to the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an exemplary developing unit 200 of an image forming apparatus using a two-component development apparatus according to a preferred embodiment of the present invention is now described.

As shown in FIG. 1, a development unit 13 arranged close to a photosensitive drum 1, which is a latent image carrier, mainly includes a support case 14, a developing sleeve 15 serving as a developer carrier, a developer containing member 16*a*, a first regulating member 17 serving as a developer regulating member, and a second regulating member 23.

The support case 14 having an opening near the photosensitive drum 1 includes a toner hopper 19. The toner hopper 19 serves as a toner container for containing a toner 18 therein. The developer containing member 16*a* is formed integrally with the support case 14 near the photosensitive drum 1 to the opposite side of the toner hopper 19. The developer containing member 16*a* forms a developer container 16 for containing a developer 22 including a carrier made of the toner 18 and magnetic particles. The support case 14, positioned below the developer container 16, includes a protrusion 14*a* having an opposing face 14*b*. The support case 14 also includes a toner supply opening 20 for supplying the toner 18 through a space between the bottom of the developer container 16 and the opposing face 14*b*.

Disposed inside the toner hopper 19 is a toner agitator 21 which serves as a toner supplying mechanism rotated by a driving mechanism (not shown). The toner agitator 21 rotates in a direction of an arrow (c) as shown to agitatedly convey the toner 18 contained in the toner hopper 19 toward the toner supply opening 20.

The photosensitive drum 1 rotates in a direction of an arrow (a) as shown using a driving mechanism (not shown). The developing sleeve 15, disposed between the photosensitive drum 1 and the toner hopper 19, is opposed to the photosensitive drum 1 with a development gap (i.e., a processing gap). The developing sleeve 15 rotates in a direction of an arrow (b) as shown using a driving mechanism (not shown). The developing sleeve 15 includes therein a magnet (not shown) which serves as a magnetic field generator. The magnet is fixed in a relative position of magnetic pole with respect to the development unit 13.

The first regulating member 17 is disposed on one end of the developer containing member 16*a* and over the top of the developing sleeve 15. The first regulating member 17 is disposed between one end of the first regulating member 17 and an outer circumferential surface of the developing sleeve 15 with a fixed gap. On the other hand, the second regulating member 23 is arranged near the toner supply opening 20 of the developer container 16. The second regulating member 23 has one end integrally disposed on the developer container 16*a* with the other end arranged with a fixed gap to the outer circumferential surface of the developing sleeve 15 (i.e., toward the center of the developing sleeve 15). That is, the second regulating member 23 is disposed in a direction against a flow of the developer 22 formed on a surface of the developing sleeve 15.

Disposed at an upstream side of the first regulating member 17 on the developer container 16*a* and at a downstream side of the second regulating member 23 is a cylindrical developer stirring member 30. The developer stirring member 30 is driven to rotate in a similar direction of the developing sleeve 15 (i.e., in a direction of an arrow (d)) by a driving mechanism (not shown). The developer stirring member 30, made of ferromagnet, is magnetized by the magnet in the developing sleeve 15 so that it can attract and convey a magnetic developer. The developer container 16 is configured to have sufficient spaces to circularly move the developer 22 within a range of magnetic force of the developing sleeve 15.

The opposing face 14*b* of the support case 14 is formed over a predetermined length so as to slope downward from the toner hopper 19 toward the developing sleeve 15. When vibration, magnetic force variation of the magnet (not shown) disposed in the developing sleeve 15, and a partial increase, in toner concentration in the developer 22 are generated to drop the carrier in the developer container 16 between the second regulating member 23 and a circumferential surface of the developing sleeve 15, the dropped carrier is received by the opposing face 14*b* to move toward the developing sleeve 15. Then, the carrier is attracted to the developing sleeve 15 with a magnetic force and is replenished to the developer container 16. This structure prevents a decrease in an amount of carrier in the developer container 16. This structure also prevents uneven image concentration of the developing sleeve 15 in the axial direction at a time of image formation. An inclination angle $\alpha$ of the opposing face 14*b* is preferably about at 5 degrees, for example. A length of the opposing face 14*b* is about 2 to 20 mm, for example, preferably about 3 to 10 mm.

With the above-mentioned structure, the toner 18, which is conveyed by the agitator 21 from the inside of the toner hopper 19, is fed to the developer 22 carried by the developing sleeve 15 through the toner supply opening 20 and is conveyed to the developer container 16. The developer 22 in the developer container 16 is separated with two flows. One is to pass through a gap (i.e., a doctor gap) between the developing sleeve 15 and the developer stirring member 30. The other is to be attracted to the developer stirring member 30 and is conveyed on the developer stirring member 30 in a direction of an arrow (d). Since the latter is agitated before reaching the first regulating member 17, the replenished toner is sufficiently dispersed. Then, the developer passes through a gap between the first regulating member 17 and the developing sleeve 15 and is conveyed to a position opposed to an outer circumferential surface of the photosensitive drum 1. Only toner 18 is electrostatically connected to an electrostatic image on the photosensitive drum 1, thereby forming a toner image on the photosensitive drum 1.

An end of the second regulating member 23, there is provided a support member 40 on the second regulating member 23. The support member 40 prevents an increase in developer amount of the developer container 16 at an end of the second regulating member 23 due to deviations and inclinations of a gap (i.e., a predoctor gap) in a longitudinal direction (i.e., in a vertical direction in the drawing) of the second regulating member 23. The support member 40 also prevents the above-mentioned loss in image concentration and provides sufficient stability for an inclination of the machine. Although the support member 40 is provided on one end of the second regulating member 23 (i.e., on one end side of an increase in the developer) in the above-mentioned example, the support member 40 may be provided on both ends or provided on both ends and an intermediate section of the second regulating member 23.

Figure 2B:
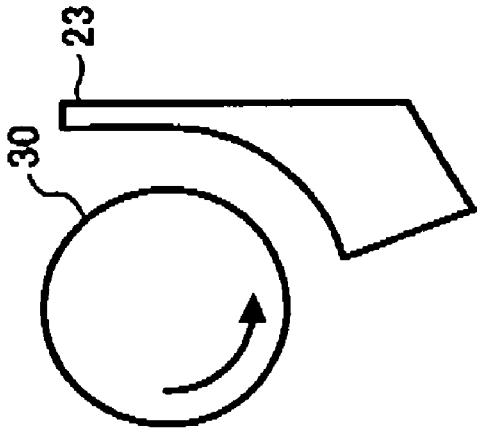
FIG. 2B is a simplified schematic drawing illustrating a curved surface of a support member in accordance with a shape of the developer stirring member.
Figure 2A:
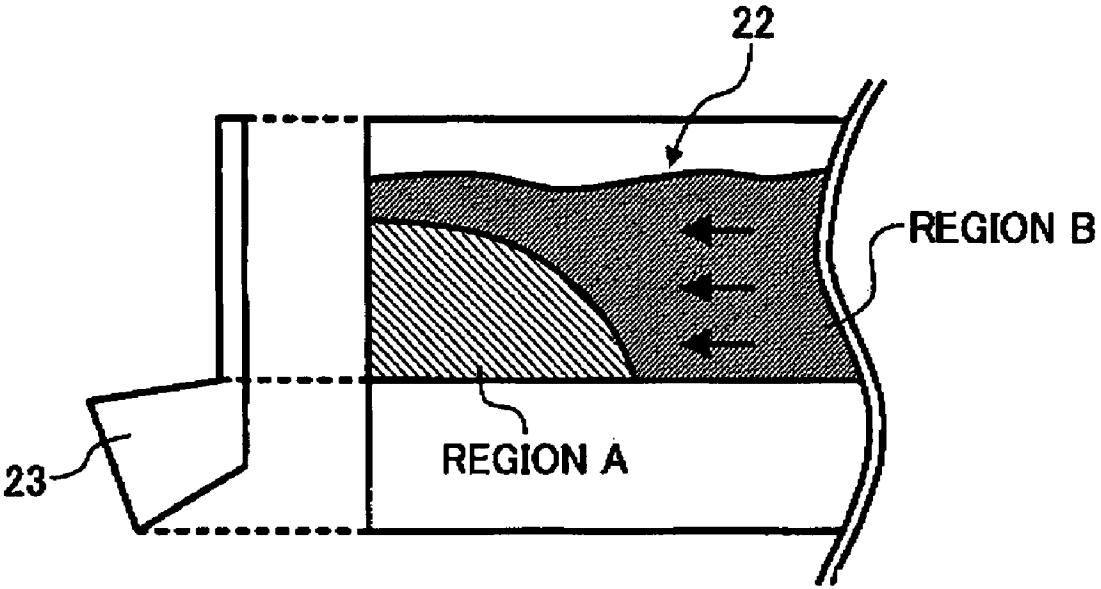
FIG. 2A is a simplified schematic drawing illustrating a flow and accumulation of a developer in a direction of an end of a second regulating member.

When there is no support member 40 on the second regulating member 23 and a gap between the first regulating member 17 and the second first regulating member 23 is deviated right and left (i.e., in the axial direction), a developer flows from a region B in which the developer 22 flows smoothly in a direction of an end of the second regulating member 23 as show in FIG. 2A. This flow forms a region A in which the developer 22 is accumulated. The region A is a high developer concentration region where the flow of the developer 22 is compressed in a direction of an end of the second regulating member 23. In the region A, the developer stirring member 30 conveys less toner to a downward direction. This is because the high developer concentration region A in the developer 22 impedes the general downward flow of the developer 22. In addition, a high triboelectrification of developer particle significantly fractionizes developers, which disrupts the flow of the developer 22 in a downstream direction. Further, when the developer insufficiently flows from the second regulating member 23 in a downstream direction, the developer is increased before passing through the second regulating member 23 so that the developer has difficulty in passing through the second regulating member 23. As mentioned previously, this decrease in toner feed provides insufficient toner and decreased toner concentration, causing a loss in image concentration. Similarly, when the developing unit is tilted side-to-side, the developer flows downward so that the region A exists at a place where the flow of the developer passing through the second regulating member 23 is accumulated. In this region, since the developer 22 has difficulty in flowing downward, the developer 22 is increased before it passes through the second regulating member 23, where toner fading is generated due to insufficient toner supply.

To avoid this problem, the support member 40 is disposed on the end of the second regulating member 23 so that the developer 22, which passes through the second regulating member 23, smoothly flows downward by eliminating the developer-accumulated region A. Further, an upper front surface of the support member 40 (i.e., a surface oppose to the developer stirring member 30) is formed as a curved surface (see FIG. 2B) in accordance with a shape of the developer stirring member 30 so as to maintain almost constant intervals between the developer stirring member 30 and the support member 40. This structure enhances feeding property of the developer stirring member 30. As a result, the second regulating member 23 also has a smoothing development flow like the region B at the end thereof, eliminating a loss in image concentration. Although the upper front surface of the support member 40 is preferably formed as a curved surface in the above-mentioned example, it may be shaped like a flat surface. With such structure, the support member 40 is also inclined downward.

In the following examples are described several preferred embodiments to illustrate the invention. All examples are explained based on the following conditions.

(1) Developing sleeve/photosensitive drum linear velocity ratio: 2.

(2) Doctor gap: 0.32 mm.

(3) Predoctor gap: 1.12 mm.

(4) Development gap (Processing gap): 0.33 mm.

(5) Toner concentration (TC) in equilibrium state based on the above-mentioned gap condition: 8±3 wt %.

(6) Magnetic ground toner: average particle size 7.2 μm.

(7) Carrier: average particle size 50 μm.

Figures 3A, 3B:
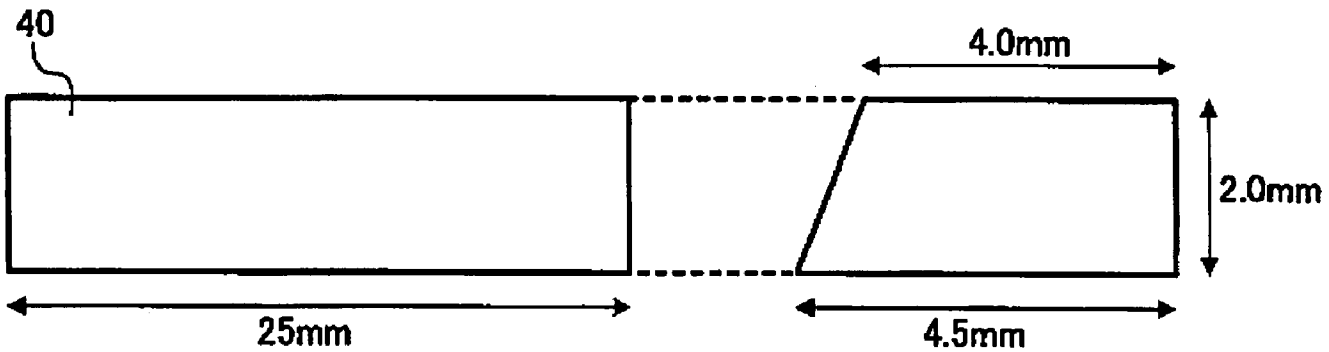
FIG. 3A illustrates an example of measurement results according to a preferred embodiment of the present invention.
FIG. 3B illustrates an exemplary structure of a support member according to a preferred embodiment of the present invention.
Figure 4C:
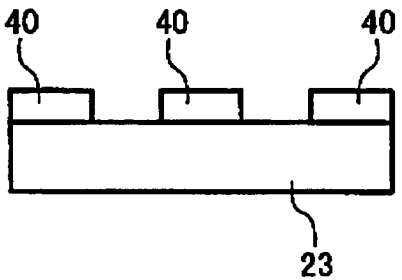
FIG. 4C is a perspective view of a support member provided on both ends and an intermediate section of the second regulating member.
Figure 4B:
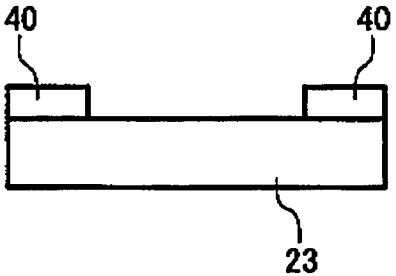
FIG. 4B is a perspective view of a support member provided on both ends of a second regulating member.
Figure 4A:
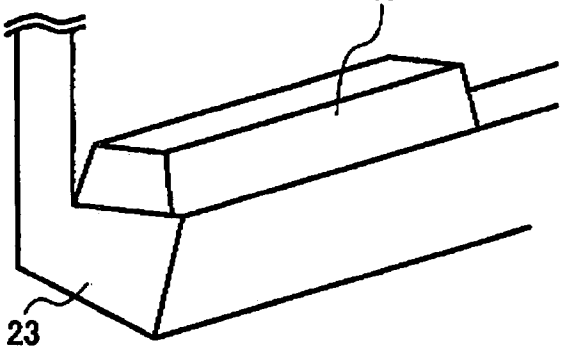
FIG. 4A is a perspective view of an example of a second regulating member seen from the right end in a sheet moving direction according to a preferred embodiment of the present invention.

In one example, the support member 40 is disposed on a right end of the second regulating member 23 in a sheet moving direction to print 1,000 images on A4 size sheets and then to measure a black image concentration at a right end and a middle portion. As a comparative example, similar printing is performed without disposing the support member 40 to measure image concentration. The center position of measurement is set at the center of an image forming area and the end is measured about 10 mm inside from the image forming area. Measurement results are shown in FIG. 3A. The support member 40 is formed as shown in FIG. 3B. The material of the support member 40 is acrylonatrile butadiene styrene (ABS). FIG. 4A shows the support member 40 disposed on the second regulating member 23. FIG. 4A is a perspective view of a second regulating member 23 seen from the right end in a sheet moving direction. In FIG. 4A, the developing sleeve 15 is located at the right of the second regulating member 23. Alternatively, the support member 40 may be provided on both ends (see FIG. 4B) or provided on both ends and an intermediate section of the second regulating member 23 (see FIG. 4C).

Figure 5:
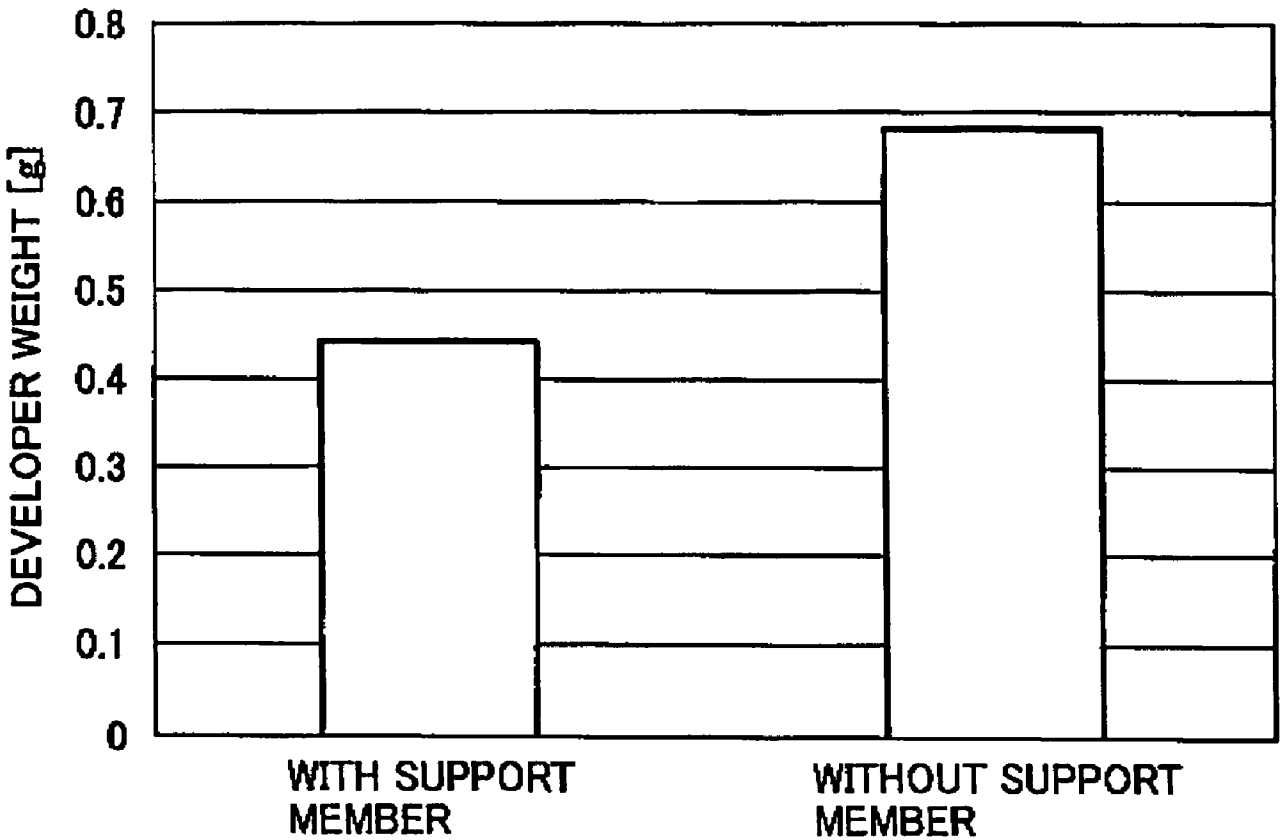
FIG. 5 is a drawing illustrating an example of developer weight measurement result according to a preferred embodiment of the present invention.

Subsequently, prior to passing through the second regulating member 23, a developer weight is compared with and without the support member 40. The developer 22 is placed into the development unit 13, where the development unit 13 is driven to rotate the photosensitive drum 1 at a linear velocity of 120 mm/minute over 3 minutes before developer weight measurements. The measurement results are shown in FIG. 5. When the developer weight is measured, the developer 22 is sampled from the toner supply opening 20 with a bar magnet before the developer 22 passes through the second regulating member 23. The developer sample is taken up to 25 mm from a right end of the support member 40 in a sheet moving direction. FIG. 5 shows the developer is decreased about 40 percent before it passes through the second regulating member 23 when the support member 40 is disposed on the second regulating member 23.

Figure 6:
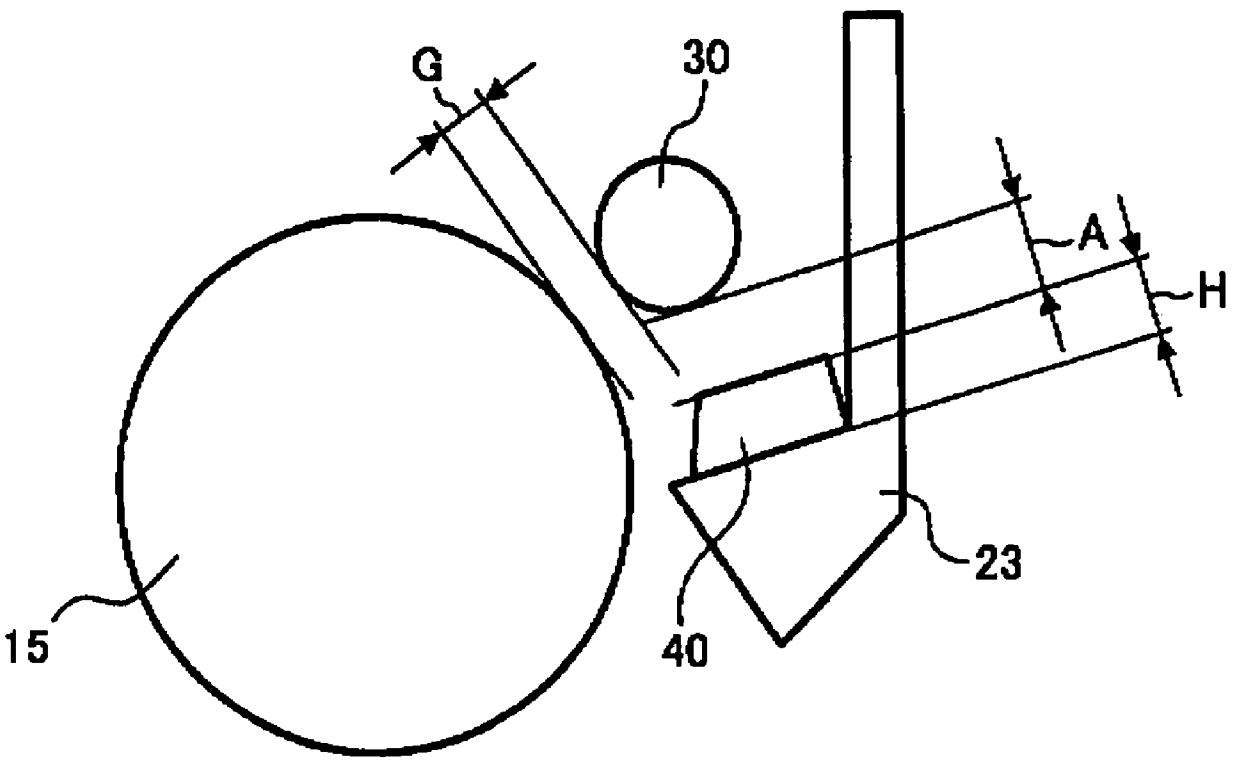
FIG. 6 is a simplified schematic drawing illustrating an example of positional relationship between a developer stirring member and a support member according to a preferred embodiment of the present invention.
Figure 7:
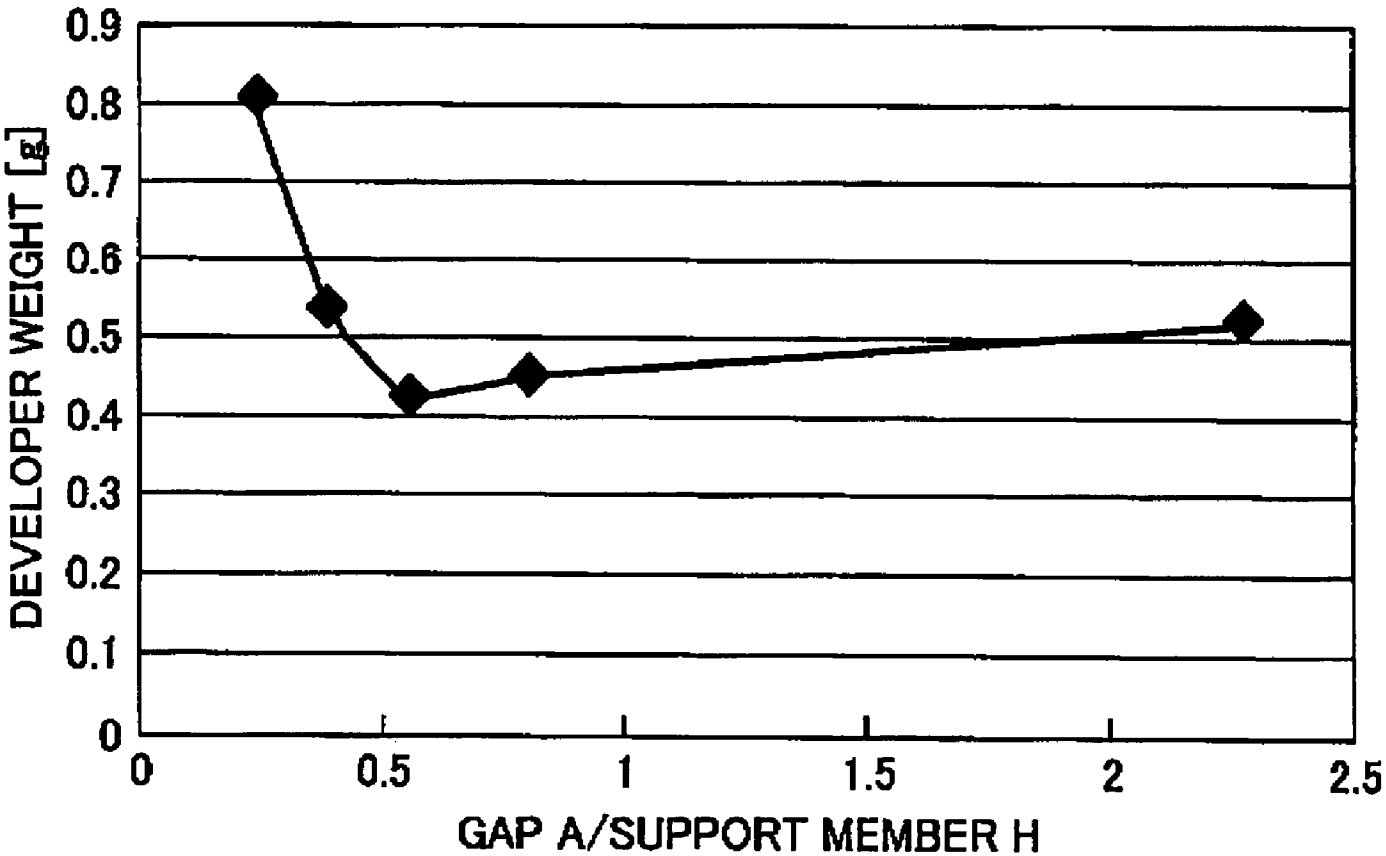
FIG. 7 is a drawing illustrating an example of developer weight measurement result according to a preferred embodiment of the present invention.

In another example, the support member 40 is disposed on a right end of the second regulating member 23 in a sheet moving direction and a gap A between the developer stirring member 30 and the support member 40 is changed to measure the developer weight before it passes through the right end of the second regulating member 23. The support member 40, formed as shown in FIG. 3B, is different in thickness H. The material of the support member 40 is ABS. FIG. 6 shows a positional relationship between the developer stirring member 30 and the support member 40. The developer 22 is placed in the developer container 16, 16 where the developer container 16 is driven to rotate the photosensitive drum 1 at a linear velocity of 120 mm/minute over 3 minutes before developer weight measurements prior to the developer passing through the second regulating member 23. The developer sample is taken up to 25 mm from a right end of the support member 40 in a sheet moving direction. FIG. 7 shows a measurement result of the developer weight to a ratio (i.e., A/H) between the gap A and the thickness H of the support member. As can be seen from FIG. 7, a minimum value exists when A/H is 0.6. Moreover, when the support member 40 has the thickness H significantly smaller than the gap A, the A/H has a significantly larger value. However, when H is equal to 0, the developer weighs 0.7 g. As a result, when the developer weighs less than 0.7 g, the support member 40 provides an effective control. The resulting A/H is at least 0.3.

Figure 8:
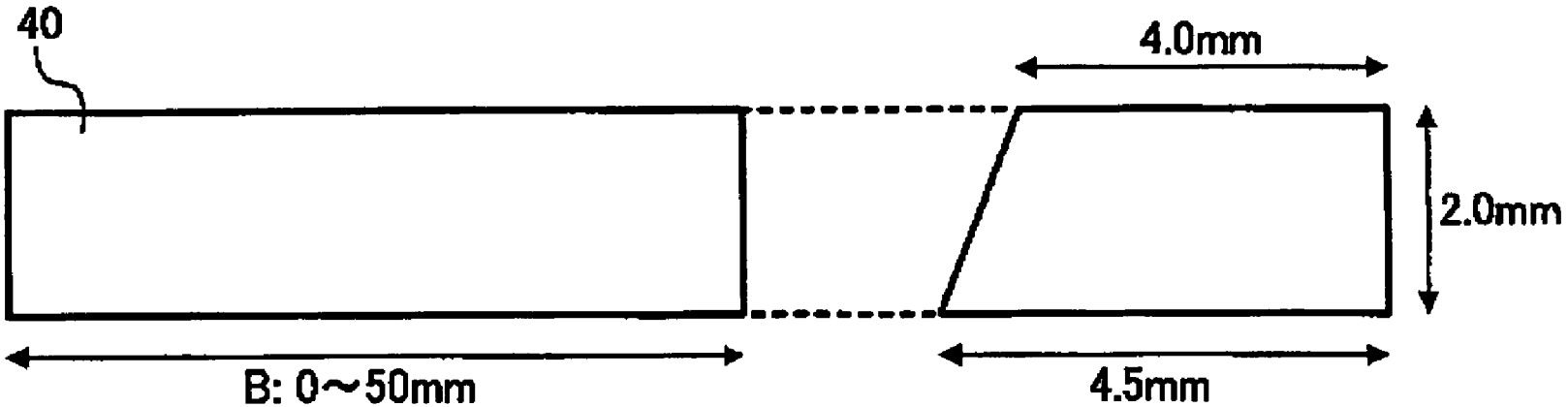
FIG. 8 illustrates an exemplary structure of a support member according to a preferred embodiment of the present invention.
Figure 9:
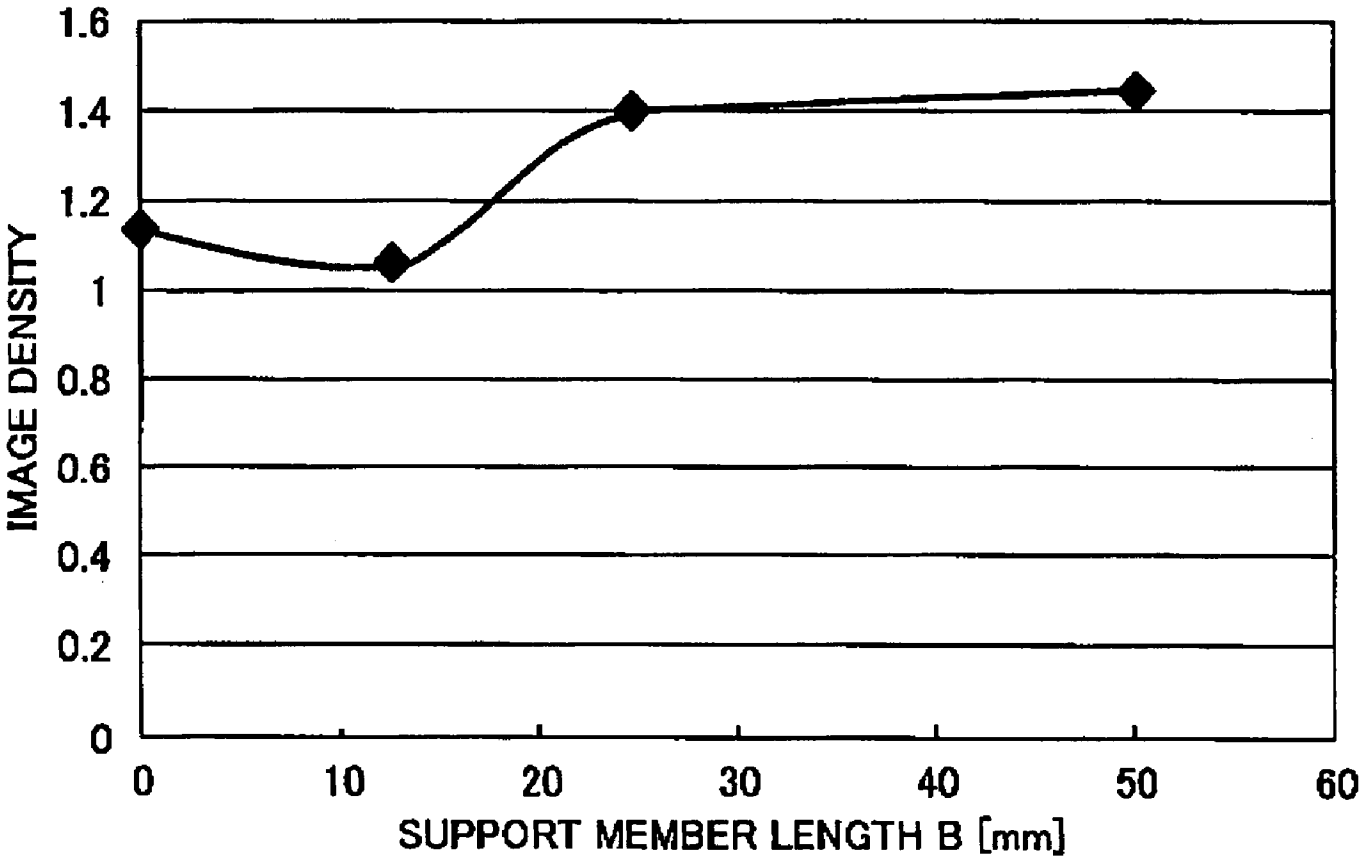
FIG. 9 is a drawing illustrating an exemplary image concentration measurement result according to a preferred embodiment of the present invention.

In still another example, the length B of the support member 40 in a longitudinal direction is varied to print 1,000 images on A4 size sheets and then to measure black image concentration. The support member 40 is formed as shown in FIG. 8. The measurement result is shown in FIG. 9. As can be seen from FIG. 9, the support member 40 having a length of at least 20 mm provides an effective control in comparison with no support member 40 disposed on the second regulating member 23. More preferably, the support member 40 has a length of at least 25 mm.

Figure 10:
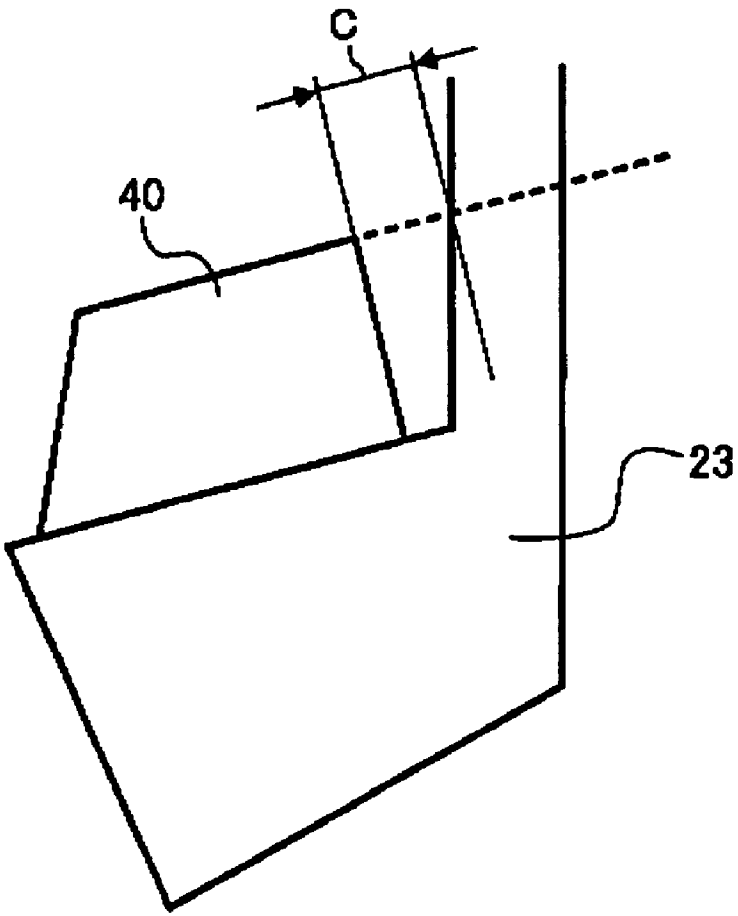
FIG. 10 is a simplified schematic drawing illustrating an example of positional relationship between a support member and a second regulating member according to a preferred embodiment of the present invention.
Figure 11:
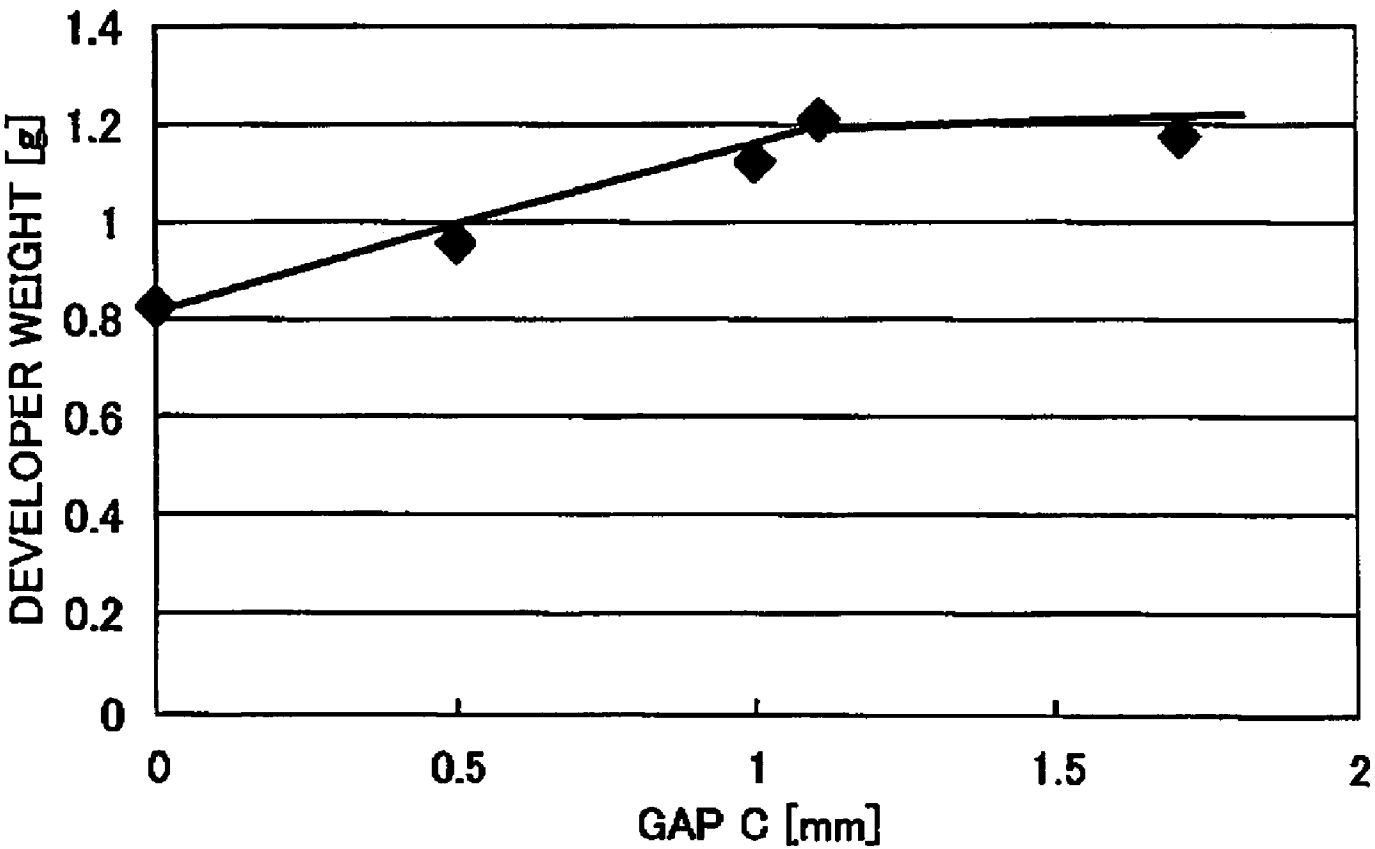
FIG. 11 is a drawing illustrating an example of a developer weight measurement result according to a preferred embodiment of the present invention.

In yet another example, the support member 40 is disposed on a right end of the second regulating member 23 in a sheet moving direction and a gap C between the support member 40 and the second regulating member 23 is changed in the vertical direction to measure the developer before it passes through the second regulating member 23. FIG. 10 shows a positional relationship between and the support member 40 and the second regulating member 23. The developer 22 is placed in the development unit 13, where the development unit 13 is driven to rotate photosensitive drum 1 at a linear velocity of 120 mm/minute over 3 minutes before developer weight measurements. The developer sample is taken up to 25 mm from a right end of the support member 40 in a sheet moving direction. The measurement result is shown in FIG. 11. When the gap C is at least 1.0 mm, the developer weight is saturated before the developer passes through the second regulating member 23. When the support member 40 is not disposed on the second regulating member 23, the developer weighs 1.2 g (not shown in FIG. 11), which is substantially similar to saturation as shown in FIG. 11. Thus, the support member 40 having the gap C of no more than about 1.0 mm provides an effective control. More preferably, the gap C is no more than 0.5 mm in length.

Figure 12:
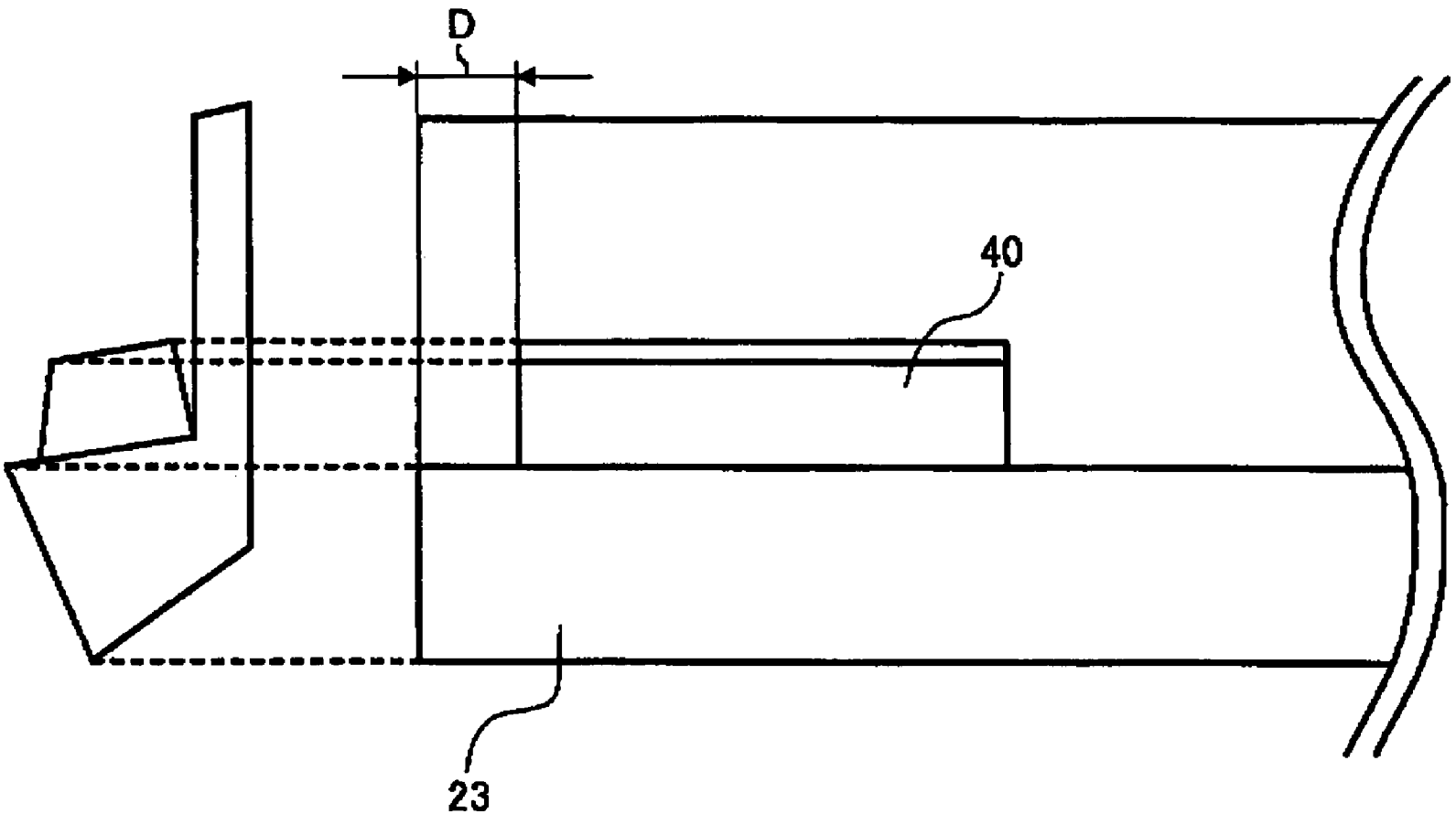
FIG. 12 is a simplified schematic drawing illustrating an example of positional relationship between a support member and a second regulating member according to a preferred embodiment of the present invention.
Figure 13:
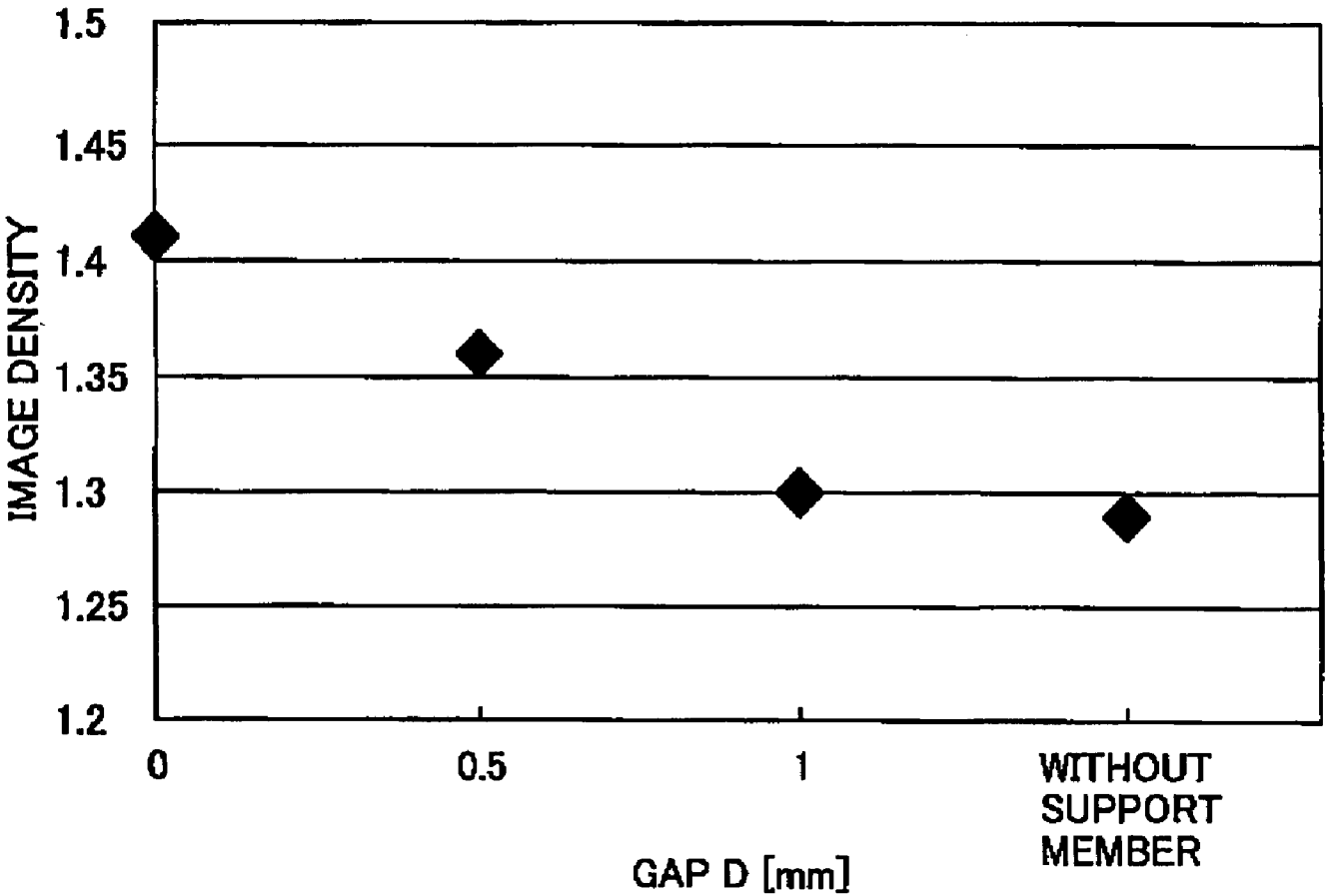
FIG. 13 is a drawing illustrating an exemplary image concentration measurement result according to a preferred embodiment of the present invention.

In another example, the support member 40 is disposed on a right end of the second regulating member 23 in a sheet moving direction and a gap D between the support member 40 and an end of the second regulating member 23 is changed to print 1,000 images on A4 size sheets. Subsequently, black image concentration is measured no more than 10 mm inside from an end of an image forming area. FIG. 12 shows a positional relationship between and the support member 40 and the end of the second regulating member 23. The measurement results are shown in FIG. 13. As can be seen from FIG. 13, the gap D increases as the image concentration decreases. When the gap D is no more than 1.0 mm, the support member 40 provides an effective control.

Figure 14:
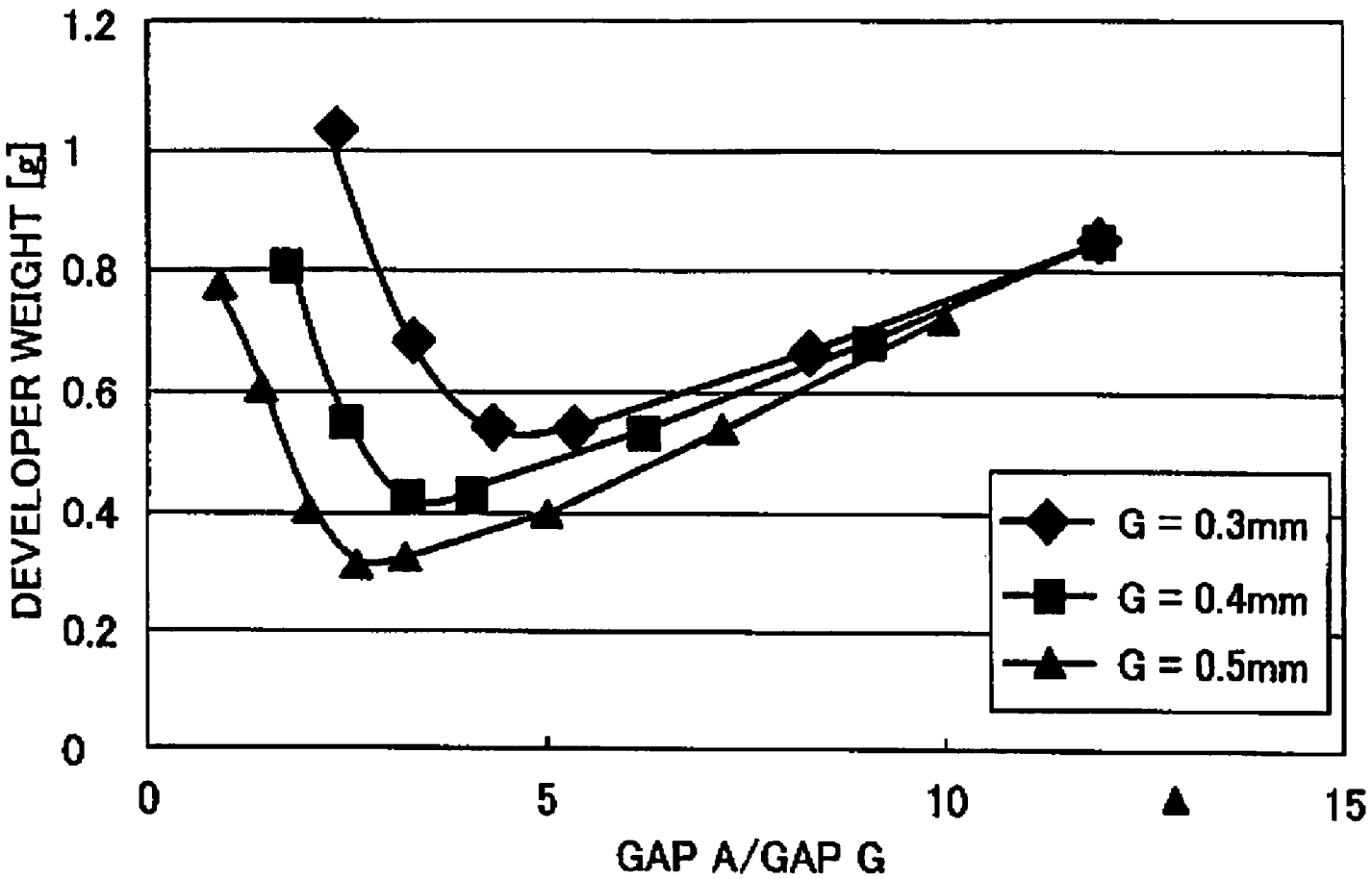
FIG. 14 is a drawing illustrating an exemplary image concentration measurement result according to a preferred embodiment of the present invention.

In still another example, as shown in FIG. 6, when a distance A between the developer stirring member 30 and the support member 40 and a ratio of a gap G (i.e., A/G) between the developing sleeve 15 and the developer stirring member 30 are changed, the developer weight is measured before the developer passes through the right end of the second regulating member 23. The result of, the development weight measurement is shown in FIG. 14. The support member 40, formed as shown in FIG. 3B, is different in thickness H. The material of the support member 40 is ABS. In addition, the gaps A and G are in millimeter (mm).

As shown in FIG. 14, changing the gap G between the developing sleeve 15 and the developer stirring member 30 changes A/G curved line. When the support member 40 is not disposed on the second regulating member 23, the developer weighs 0.7 g as mentioned previously so that the developer no more than 0.7 g is effective. In the A/G curved line which is no more than 0.7 g in the developer weight, a plurality of A/G curved lines are substantially collinear when the gap G is changed in the upper portion. The value is at least A/G=9. In the lower portion, increasing the gap G shifts the A/G curved line to a smaller side. The A/G curved line lies on straight line approximation A/G=6–10G. That is, $(6-10\times G)\leqq A/G\leqq 9$ is the preferred range.

Figure 15:
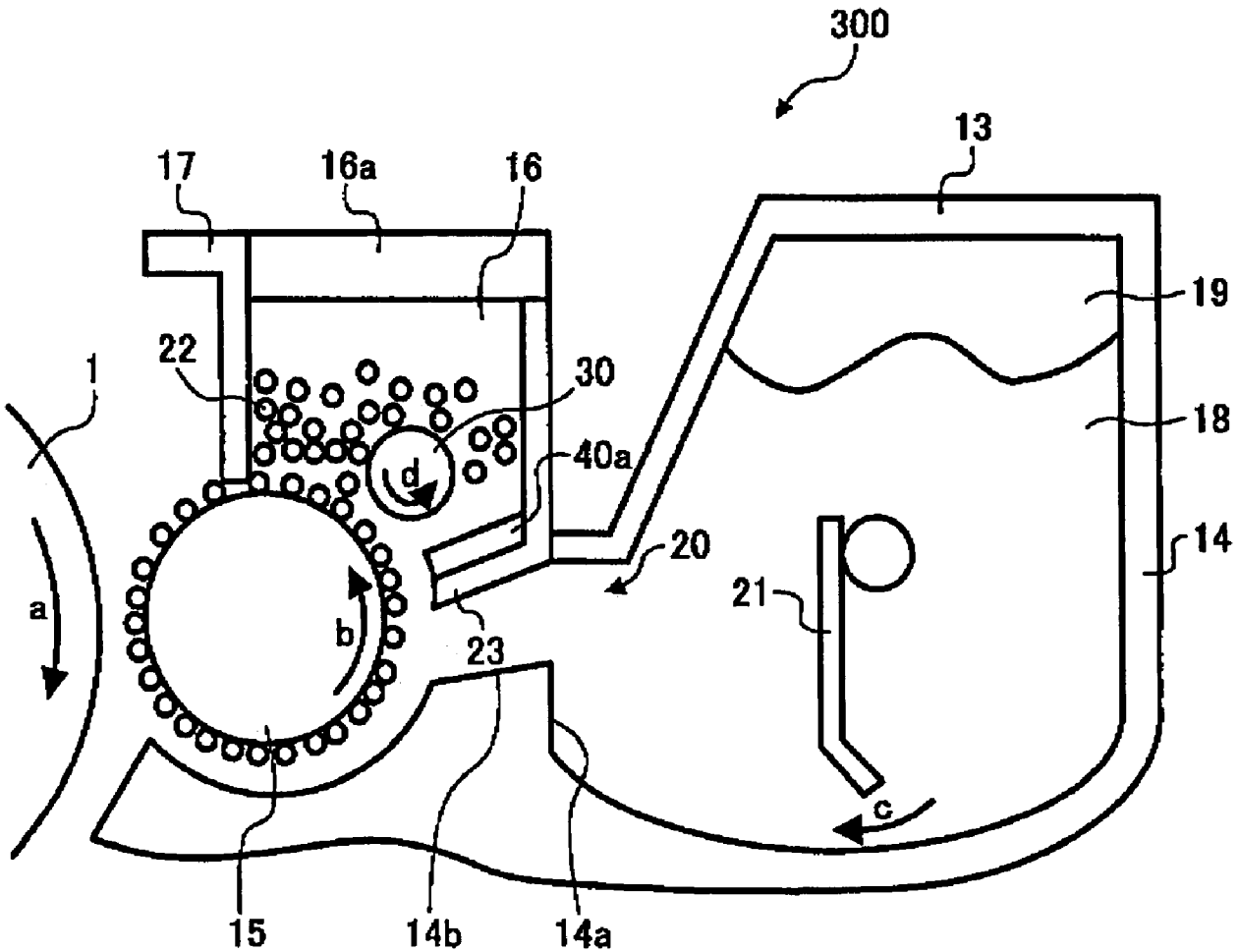
FIG. 15 is a schematic drawing illustrating an exemplary developing unit 300 of an image forming apparatus using another preferred embodiment of a two-component development apparatus according to the present invention.

Referring to the FIG. 15, another developing unit 300 of an image forming apparatus using a two-component development apparatus according to a preferred embodiment of the present invention is now described. In this embodiment, a surface of a support member 40*a* opposed to the developing sleeve 15 is formed as a curved surface in accordance with a shape of the developing sleeve 15. Other structure is similar to the above-mentioned embodiment.

In the present embodiment, a flow of the developer 22 passing through the developing sleeve 15 and the developer stirring member 30 and the developer 22 conveyed by the developer stirring member 30 can be separated. This structure provides sufficient toner supply without affecting the flow of the developer 22 passing through the second regulating member 23.

The surface of the support member 40*a* opposed to the developing sleeve 15 can not only be formed as a curved surface as in the present embodiment, but an upper front surface of the support member 40 can also be formed as a curved surface as in the above-mentioned embodiment. Since each embodiment has its own benefit, both structures of embodiments may be preferably combined.

Figure 16:
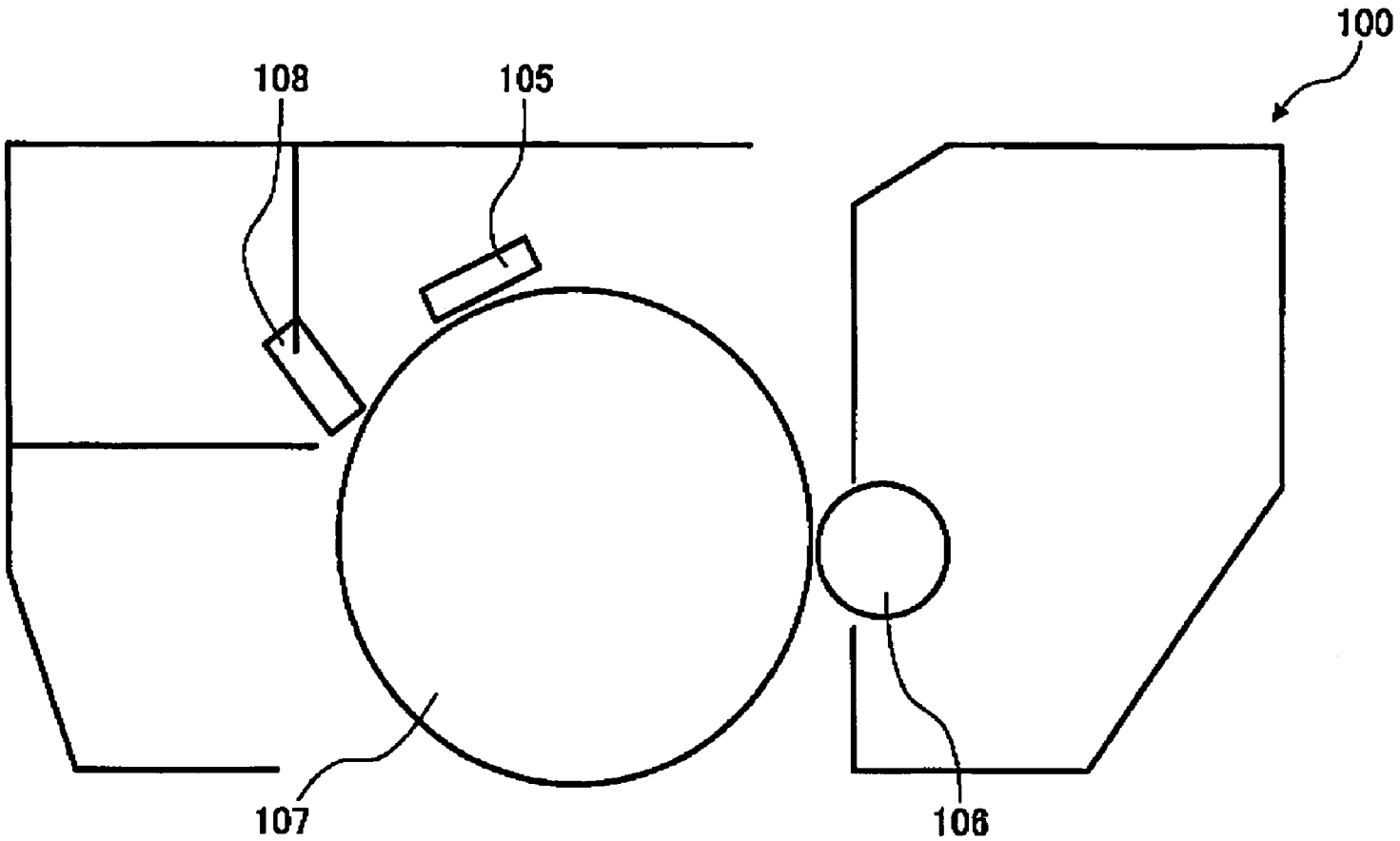
FIG. 16 is a schematic cross sectional view of a process cartridge configured to integrally combine a preferred embodiment of a two-component development apparatus with a photoconductor and the like according to the present invention.

FIG. 16 is a schematic cross sectional view of a process cartridge 100 configured to integrally combine a preferred embodiment of a two-component development apparatus with a photoconductor and the like according to the above-mentioned invention. The process cartridge according to the present embodiment is. removably attached to an image forming apparatus such as a copier and a printer. In FIG. 16, a charging mechanism 105, a developing mechanism 106, a photosensitive drum 107, and a cleaning mechanism 108 are unitized as a single package.

The image forming apparatus using the process cartridge 100 according to the present invention is driven to rotate the photosensitive drum 107 at a predetermined peripheral velocity, where the charging mechanism 105 uniformly charges a circumferential surface of the photosensitive drum 107 at a negative or positive predetermined potential. Image exposure mechanisms (not shown) such as a slit exposure and a laser beam scanning exposure irradiate an image exposing light to sequentially form an electrastatic latent image on the circumferential surface of the photosensitive drum 107. The resultant electrostatic latent image is developed with toner using the developing mechanism 106 to supply a recording material such as a sheet in synchronism with a rotating of the photoconductor between the photosensitive drum 107 and a transfer unit (not shown) from a sheet supply station (not shown). The transfer unit sequentially transfers a toner image on the recording material. The recording material carrying the transfer image thereon is separated from the circumferential surface of the photosensitive drum 107. Subsequently, the recording material is introduced to an image fixing unit (not shown) to fix an image with heat pressing and the like. Then, the recording material is printed out as a copy. After image transformation, the cleaning mechanism 108 removes and cleans a residual toner on the surface of the photosensitive drum 107. Further, a discharge unit (not shown) discharges the photosensitive drum 107 for repeat use in image forming.

Numerous additional modifications and variations are possible in light of the above teachings. It is therefore to be understood that within the scope of the appended claims, the disclosure of this patent specification may be practiced otherwise than as specifically described herein.

What is claimed is:

1. A two-component developing method for use in an image forming apparatus, comprising the steps of:

supplying a two-component developer;

regulating the developer on a developer carrier with a regulating member;

making a thin layer of the developer on the developer 32 carrier by scalping the developer with a blade;

storing the developer scalping in a developer container; and suppressing accumulated toner with a support member arranged on a second rgulating member.

2. A two-component developing method for use in an image forming apparatus, comprising:

a developer carrier configured to carry and transfer a two-component developer including a magnetic carrier;

a first regulating member configured to regulate an amount of the two-component developer carried and transferred by the developer carrier;

a developer container including a second regulating member positioned upstream of the first regulating member in a direction of developer conveyance of the developer carrier and configured to receive the developer removed by the first regulating member;

a toner container formed adjacent to the developer container and configured to supply toner to the developer carrier; and a developer stirring member configured to carry and stir the developer between the first regulating member and the second regulating member, wherein the second regulating member includes a support member on one end side of the second regulating member in a longitudinal direction thereof to which greater amount of the developer is supplied than to another end side of the second regulating member.

3. A two-component developing apparatus as defined in claim 2, wherein a surface of the support member opposed to the developer stirring member is formed as a curved surface in accordance with the shape of the developer stirring member.

4. The two-component developing apparatus as defined in claim 2, wherein a surface of the support member opposed to the developer carrier is formed as a curved surface in accordance with a shape of the developer carrier.

5. The two component developing apparatus as defined in claim 2, wherein the second regulating member includes another support member on one end side of the second regulating member in a longitudinal direction thereof to which greater amount of the developer is supplied than to another end side of the second regulating member.

6. The two-component developing apparatus as defined in claim 5, wherein the second regulating member further includes an additional support member at a center of the second regulating member in a longitudinal direction thereof.

7. The two-component developing apparatus as defined in claim 2, wherein a gap A between the developer stirring member and the support member and a thickness H of the support member satisfies a relationship of A/H>3.0.

8. The two-component developing apparatus as defined in claim 2, wherein a gap A between the developer stirring member and the support member and a gap G between the developer carrier and the developer stirring member have a ratio ranging from $(6-10\times G)\leqq A/G\leqq 9$.

9. A process cartridge, comprising:

a housing;

at least one of a latent image carrier, a charging mechanism, and a cleaning mechanism; and a developing mechanism configured to have a two-component developing apparatus for use in an image forming apparatus, comprising:

a developer carrier configured to carry and transfer a two-component developer including a magnetic carrier;

a first regulating member configured to regulate an amount of the two-component developer carried and transferred by the developer carrier;

a developer container including a second regulating member positioned upstream of the first regulating member in a direction of developer conveyance of the developer carrier and configured to receive the developer removed by the first regulating member;

a toner container formed adjacent to the developer container and configured to supply toner to the developer carrier; and a developer stirring member configured to carry and stir the developer between the first regulating member and the second regulating member, wherein the second regulating member includes a support member on one end side of the second regulating member in a longitudinal direction thereof to which greater amount of the developer is supplied than to another end side of the second regulating member.

10. The process cartridge as defined in claim 9, wherein a surface of the support member opposed to the developer stirring member is formed as a curved surface in accordance with a shape of the developer stirring member.

11. The process cartridge as defined in claim 9, wherein a surface of the support member opposed to the developer carrier is formed as a curved surface in accordance with a shape of the developer carrier.

12. The process cartridge as defined in claim 9, wherein the second regulating member includes another support member on one end side of the second regulating member in a longitudinal direction thereof to which greater amount of the developer is supplied than to another end side of the second regulating member.

13. The process cartridge as defined in claim 12, wherein the second regulating member further includes an additional support member at a center of the second regulating member in a longitudinal direction thereof.

14. The process cartridge as defined in claim 9, wherein a gap A between the developer stirring member; and the support member and a thickness H of the support member satisfies a relationship of $A/H>3.0$.

15. The process cartridge as defined in claim 9, wherein a gap A between the developer stirring member and the support member and a gap G between the developer carrier and the developer stirring member have a ratio ranging from $(6-10\times G)\leqq A/G\leqq 9$.

16. A two-component developing apparatus for use in an image forming apparatus, comprising:

developer carrying means for carrying and transferring a two-component developer means including a magnetic carrier means;

first regulating means for regulating an amount of the two-component developer means carried and transferred by the developer carrying means;

developer container means including a second regulating means positioned upstream of the first regulating means in a direction of developer conveyance of the developer carrying means and configured to receive the developer removed by the first regulating means;

toner container formed adjacent to the developer container means and for supplying toner to the developer carrying means; and developer stirring member for carrying and stirring the developer means between the first regulating means and the second regulating means, wherein the second regulating means includes a support means on one end side of the second regulating means in a longitudinal direction thereof to which greater amount of the developer means is supplied than to another end side of the second regulating means.

17. The two-component developing apparatus as defined in claim 16, wherein a surface of the support means opposed to the developer stirring means is formed as a curved surface in accordance with a shape of the developer stirring means.

18. The two-component developing apparatus as defined in claim 16, wherein a surface of the support means opposed to the developer carrying means is formed as a curved surface in accordance with a shape of the developer carrying means.

19. The two-component developing apparatus as defined in claim 16, wherein the second regulating means includes another support means on one end side of the second regulating means in a longitudinal direction thereof to which greater amount of the developer means is supplied than to another end side of the second regulating means.

20. The two-component developing apparatus as defined in claim 19, wherein the second regulating means further includes an additional support means at a center of the second regulating means in a longitudinal direction thereof.

21. The two-component developing apparatus as defined in claim 19, wherein a gap A between the developer stirring means and the support means and a thickness H of the support means satisfies a relationship of $A/H>3.0$.

22. The two-component developing apparatus as defined in claim 19, wherein a gap A between the developer stirring means and the support means and a gap G between the developer carrying means and the developer stirring means have a ratio ranging from $(6-10\times G)\leqq A/G\leqq 9$.

23. A process cartridge, comprising:

housing means;

at least one of a latent image carrier means, a charging means, and a cleaning means; and developing means for having a two-component developing means for use in an image forming means, comprising:

developer carrier means configured to carry and transfer a two-component developer means including a magnetic carrier means;

first regulating means configured to regulate an amount of the two-component developer means carried and transferred by the developer carrier means;

developer container means including a second regulating means positioned upstream of the first regulating means in a direction of developer conveyance of the developer carrier means and for receiving the developer means removed by the first regulating means;

toner container means formed adjacent to the developer container means and for supplying toner to the developer carrier means; and developer stirring means for carrying and stirring the developer means between the first regulating means and the second regulating means, wherein the second regulating means includes support means on one end side of the second regulating means in a longitudinal direction thereof to which greater amount of the developer means is supplied than to another end side of the second regulating means.

24. The process cartridge as defined in claim 23, wherein a surface of the support means opposed to the developer stirring means is formed as a curved surface in accordance with a shape of the developer stirring means.

25. The process cartridge as defined in claim 23, wherein a surface of the support means opposed to the developer carrier means is formed as a curved surface in accordance with a shape of the developer carrier means.

26. The process cartridge as defined in claim 23, wherein the second regulating means includes another support means on one end side of the second regulating means 31 in a longitudinal direction thereof to which greater amount of the developer means is supplied than to another end side of the second regulating means.

27. The process cartridge as defined in claim 26, wherein the second regulating means further includes an additional support means at a center of the second regulating means in a longitudinal direction thereof.

28. The process cartridge as defined in claim 23, wherein a gap A between the developer stirring means and the support means and a thickness H of the support means satisfies a relationship of $A/H>3.0$.

29. The process cartridge as defined in claim 23, wherein a gap A between the developer stirring means and the support means and a gap G between the developer carrier means and the developer stirring means have a ratio ranging from $(6-10\times G)\leqq A/G\leqq 9$.

* * * * *